US011097542B2

(12) United States Patent
Kanzaki et al.

(10) Patent No.: US 11,097,542 B2
(45) Date of Patent: Aug. 24, 2021

(54) LIQUID DISCHARGE HEAD AND LIQUID DISCHARGE APPARATUS

(71) Applicant: Brother Kogyo Kabushiki Kaisha, Nagoya (JP)

(72) Inventors: Shotaro Kanzaki, Handa (JP); Toshihiro Kishigami, Obu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/905,531

(22) Filed: Jun. 18, 2020

(65) Prior Publication Data

US 2021/0008884 A1 Jan. 14, 2021

(30) Foreign Application Priority Data

Jul. 9, 2019 (JP) ..... JP2019-127604

(51) Int. Cl.

| | |
|---|---|
| ***B41J 2/14*** | (2006.01) |
| ***B41J 2/15*** | (2006.01) |
| ***B41J 2/045*** | (2006.01) |
| ***B41J 2/175*** | (2006.01) |

(52) U.S. Cl.

CPC ..... *B41J 2/14201* (2013.01); *B41J 2/04581* (2013.01); *B41J 2/15* (2013.01); *B41J 2/175* (2013.01); *B41J 2002/14306* (2013.01)

(58) Field of Classification Search

CPC .... B41J 2/14201; B41J 2/04581; B41J 2/175; B41J 2002/14306; B41J 2/15

USPC ..... 347/20, 40, 42, 54, 68, 84, 85

See application file for complete search history.

(56) References Cited

U.S. PATENT DOCUMENTS

| | | | | |
|---|---|---|---|---|
| 10,549,539 | B2 * | 2/2020 | Katayama | B41J 2/14209 |
| 10,583,657 | B2 * | 3/2020 | Sugiura | B41J 2/1433 |
| 10,737,491 | B2 * | 8/2020 | Odaka | B41J 2/185 |
| 2017/0253037 | A1 | 9/2017 | Kobayashi | |
| 2018/0072066 | A1 | 3/2018 | Yoneta | |
| 2018/0178538 | A1 | 6/2018 | Miyazawa et al. | |

FOREIGN PATENT DOCUMENTS

| | | | |
|---|---|---|---|
| JP | 5988416 | B2 | 9/2016 |
| JP | 2018-047683 | A | 3/2018 |
| JP | 2018-103616 | A | 7/2018 |

* cited by examiner

*Primary Examiner* — An H Do

(74) *Attorney, Agent, or Firm* — Banner & Witcoff, Ltd.

(57) ABSTRACT

There is provided a liquid discharge head including a channel unit. The channel unit includes: first and second individual channel groups including a plurality of first and second individual channels; two supply manifolds and two return manifolds; and bypass channels communicating with the two supply manifolds or with the two return manifolds. A relationship of |P1|>|P2| is satisfied, wherein P1 is a first pressure of the supply manifold provided commonly for the first individual channel group, P2 is a second pressure of the supply manifold provided commonly for the second individual channel group, −P1 is a third pressure of the return manifold provided commonly for the first individual channel group, and −P2 is a fourth pressure of the return manifold provided commonly for the second individual channel group.

13 Claims, 6 Drawing Sheets

LIQUID DISCHARGE HEAD AND LIQUID DISCHARGE APPARATUS

CROSS REFERENCE TO RELATED APPLICATION

The present application claims priority from Japanese Patent Application No. 2019-127604 filed on Jul. 9, 2019, the disclosure of which is incorporated herein by reference in its entirety.

BACKGROUND

Field of the Invention:

The present disclosure relates to a liquid discharge head for discharging liquid from a discharge port, and a liquid discharge apparatus including the liquid discharge head.

Description of the Related Art:

An ink discharge head for discharging an ink is known as an example of the liquid discharge head for discharging a liquid from a discharge port. As for such a known ink discharge head, there is an ink discharge head including a plurality of individual liquid chambers (individual channels) which are communicated with a plurality of nozzles respectively, a common liquid chamber (supply manifold) which supplies the ink to the plurality of individual liquid chambers, and a circulating common liquid chamber (return manifold) into which the inks flows from the plurality of individual liquid chambers. In the case of the known ink discharge head, the ink can be fed from the common liquid chamber to the circulating common liquid chamber via the individual liquid chambers, and the ink contained in the head can be circulated.

SUMMARY

The heat, which is accumulated in the head, is dissipated by circulating the liquid contained in the head as described above. However, in the case of the configuration in which the liquid contained in the head is circulated via the individual channels, the flow resistance of the individual channel becomes relatively high, and the circulating flow rate of the liquid is decreased. Therefore, the heat, which is accumulated in the head, cannot be sufficiently dissipated. It is feared that the temperature of the head may be excessively raised, and the discharge characteristic of the liquid may be varied.

An object of the present disclosure is to provide a liquid discharge head and a liquid discharge apparatus which make it possible to sufficiently secure the circulating flow rate of the liquid.

According to an aspect of the present disclosure, there is provided a liquid discharge head including a channel unit. The channel unit includes: a first individual channel group including a plurality of first individual channels; a second individual channel group including a plurality of second individual channels; four manifolds including two supply manifolds corresponding to the first individual channel group and the second individual channel group respectively, and two return manifolds corresponding to the first individual channel group and the second individual channel group respectively, the two supply manifolds being configured to supply a liquid to the plurality of first individual channels and the plurality of second individual channels, and the two return manifolds being configured to outflow the liquid from the two supply manifolds; and a bypass channel communicating with the two supply manifolds or with the two return manifolds, without passing through the plurality of first individual channels or the plurality of second individual channels. A relationship of $|P1|>|P2|$ is satisfied, wherein P1 is a first pressure of the supply manifold provided commonly for the first individual channel group, P2 is a second pressure of the supply manifold provided commonly for the second individual channel group, −P1 is a third pressure of the return manifold provided commonly for the first individual channel group, and −P2 is a fourth pressure of the return manifold provided commonly for the second individual channel group.

In the case of the liquid discharge head configured as described above, the relationship of $|P1|>|P2|$ is satisfied. Therefore, it is possible to simultaneously move the liquid between the two supply manifolds, between the two return manifolds, between the supply manifold and the return manifold provided commonly for the first individual channel group, and between the supply manifold and the return manifold provided commonly for the second individual channel group. Therefore, it is possible to move the liquid between the two supply manifolds and between the two return manifolds by means of the bypass channel, without passing through the first individual channel and the second individual channel each having a relatively high flow resistance, while moving the liquid between the supply manifold and the return manifold.

DESCRIPTION OF THE PREFERRED EMBODIMENTS

An embodiment of the present disclosure will be explained below.

<Overall Construction of Printer>

Figure 1:
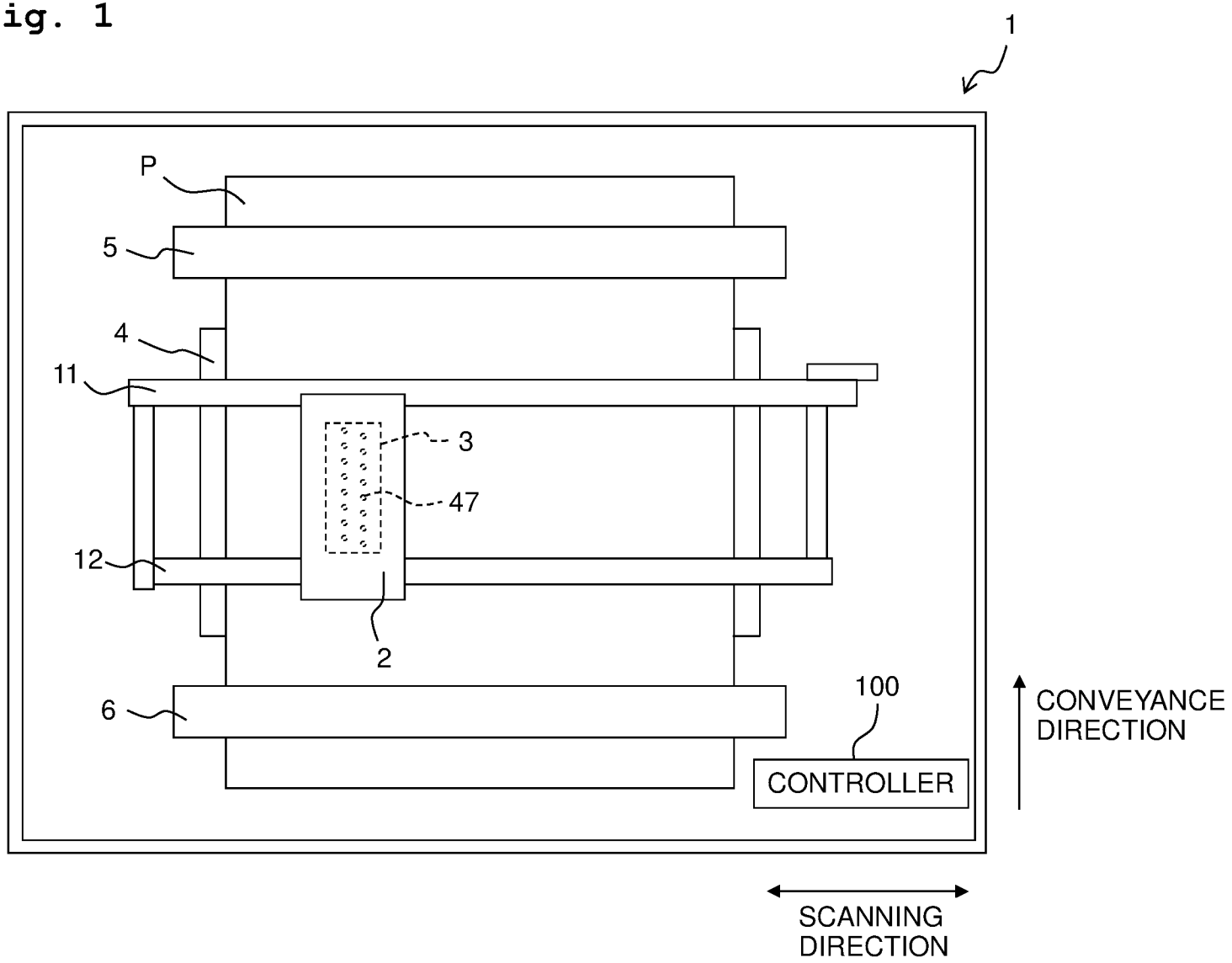
FIG. 1 depicts a plan view illustrating a printer provided with an ink-jet head according to an embodiment of the present disclosure.
Figure 2:
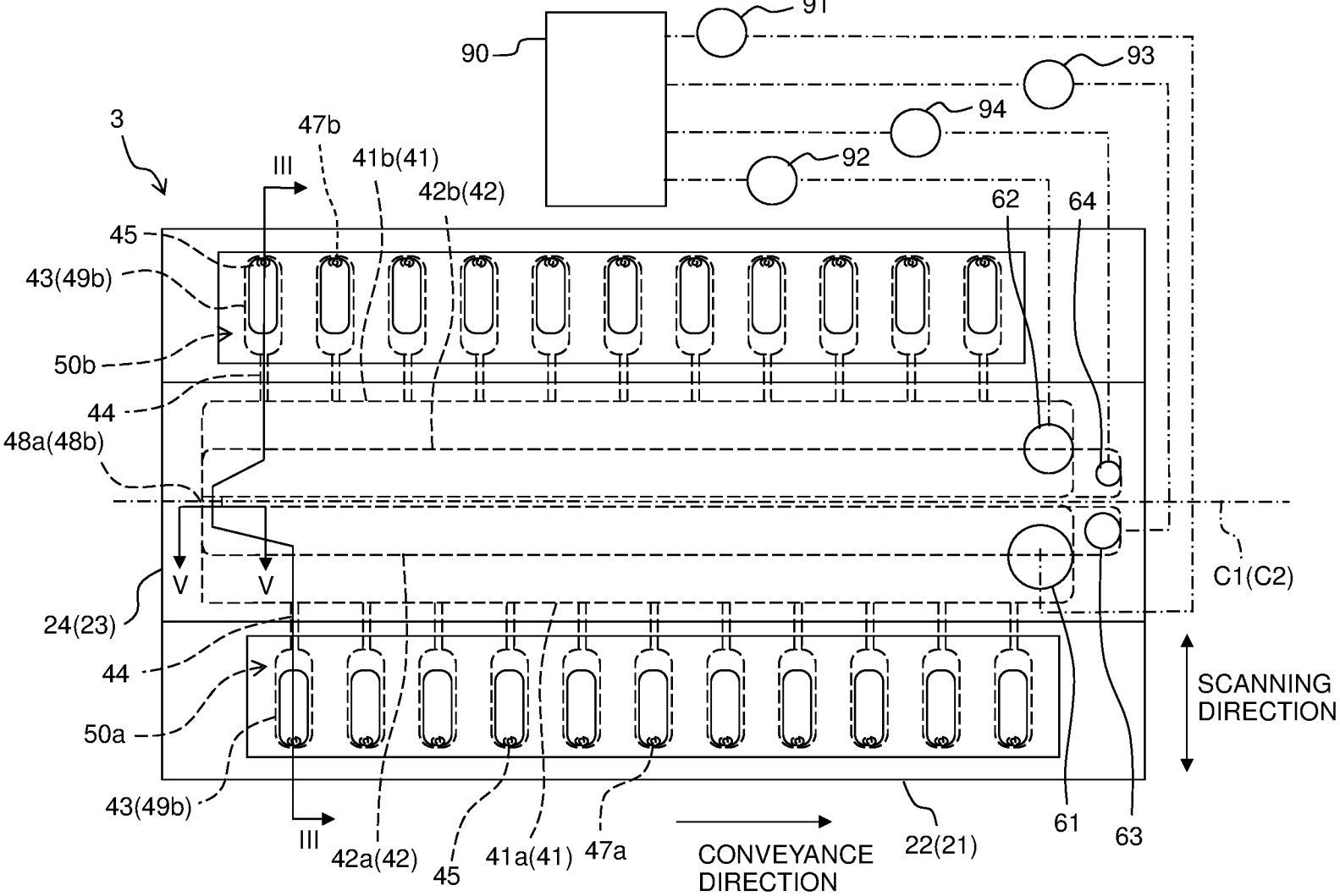
FIG. 2 depicts a plan view illustrating the ink-jet head depicted in FIG. 1.

As depicted in FIGS. 1 and 2, a printer 1 according to this embodiment ("liquid discharge apparatus" of the present disclosure) includes a carriage 2, guide rails 11, 12, an ink-jet head 3 ("liquid discharge head" of the present disclosure), a platen 4, conveying rollers 5, 6, an ink tank 90, supply pumps 91, 92, return pumps 93, 94, and a controller 100.

The carriage 2 is supported by the two guide rails 11, 12 which extend in the scanning direction (left-right direction as viewed in FIG. 1), and the carriage 2 is movable in the scanning direction along the guide rails 11, 12. The ink-jet head 3 is carried on the carriage 2, and the ink-jet head 3 is movable in the scanning direction together with the carriage 2. An ink is supplied to the ink-jet head 3 by means of the supply pumps 91, 92 from the ink tank 90 for storing the ink via an unillustrated tube. Further, a part of the ink, which is supplied to the ink-jet head 3, is returned to the ink tank 90 by means of the return pumps 93, 94. Then, the ink-jet head 3 discharges the ink from a plurality of first discharge ports 47*a* and a plurality of second discharge ports 47*b* which are formed on a lower surface thereof. Note that the ink-jet head 3 will be explained in detail later on.

The controller 100 controls the driving of the supply pumps 91, 92 and the return pumps 93, 94. In this embodiment, the controller 100 controls the turning ON/OFF of the supply pumps 91, 92 and the return pumps 93, 94. When the supply pumps 91, 92 and the return pumps 93, 94 are turned ON by the controller 100, any one of them is driven at an identical predetermined number of revolutions.

The platen 4 is arranged opposingly to the lower surface of the ink-jet head 3. The platen 4 extends over the entire length of the recording paper P in the scanning direction. The platen 4 supports the recording paper P at lower positions. The conveying rollers 5, 6 are positioned on the upstream side and the downstream side from the carriage 2 in the conveying direction (direction directed from the downward to the upward as viewed in FIG. 1) which is orthogonal to the scanning direction respectively. The conveying rollers 5, 6 convey the recording paper P in the conveying direction.

The printer 1 alternately performs the conveyance process in which the recording paper P is conveyed by every predetermined distance in the conveying direction by means of the conveying rollers 5, 6 and the scan process in which the ink is discharged from the plurality of first discharge ports 47*a* and the plurality of second discharge ports 47*b* of the ink-jet head 3 while moving the carriage 2 in the scanning direction. Accordingly, the printing is performed on the recording paper P. That is, the printer 1 is of the serial type. Note that in the following explanation, the direction, which is orthogonal to both of the scanning direction and the conveying direction, is designated as "upward-downward direction".

<Ink-Jet Head 3>

Figure 3:
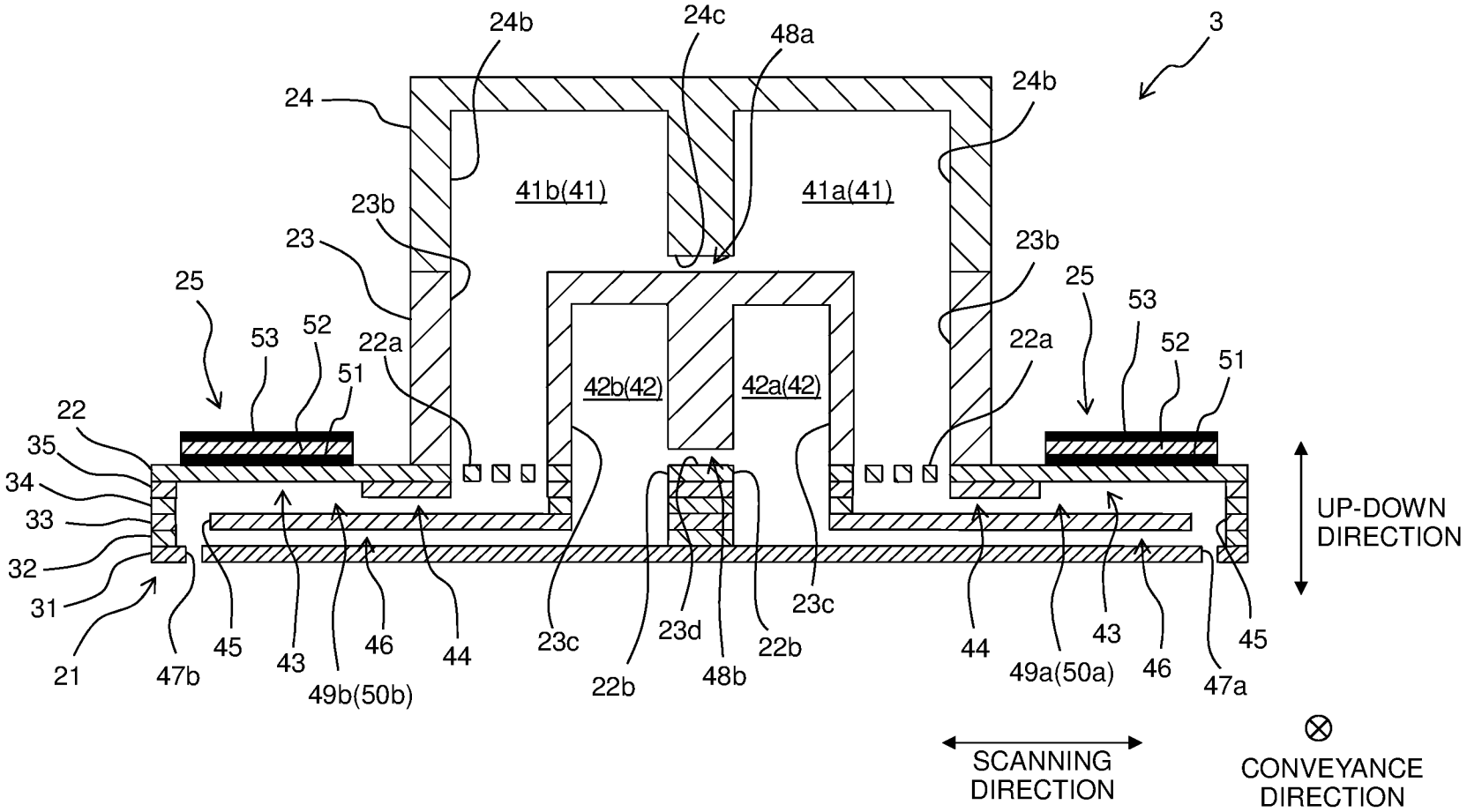
FIG. 3 depicts a sectional view illustrating the ink-jet head taken along a line depicted in FIG. 2.

Next, an explanation will be made about detailed configuration of the ink-jet head 3 with reference to FIGS. 2 and 3. As depicted in FIG. 2, the ink-jet head 3 has a rectangular shape which is elongated in the conveying direction as viewed in a top view. As depicted in FIG. 3, the ink-jet head 3 includes, for example, a channel member 21, a vibration plate 22, a first manifold member 23, a second manifold member 24, and a piezoelectric element 25 including a common electrode 51, a piezoelectric member 52, and individual electrodes 53. The channel member 21, the vibration plate 22, the first manifold member 23, and the second manifold member 24 are stacked in this order as referred to from those disposed at lower positions. The channel member 21, the vibration plate 22, the first manifold member 23, and the second manifold member 24 correspond to the channel unit of the present disclosure.

As depicted in FIGS. 2 and 3, the ink-jet head 3 includes, for example, two supply manifolds 41*a*, 41*b*, two return manifolds 42*a*, 42*b*, bypass channels 48*a*, 48*b*, a first individual channel group 50*a*, a second individual channel group 50*b*, supply ports 61, 62, and return ports 63, 64. The first individual channel group 50*a* includes a plurality of first individual channels 49*a*, and the second individual channel group 50*b* includes a plurality of second individual channels 49*b*. In the following explanation, the two supply manifolds 41*a*, 41*b* are referred to as "supply manifolds 41", if they are not distinguished from each other. Further, the two return manifolds 42*a*, 42*b* are referred to as "return manifolds 42", if they are not distinguished from each other.

The supply manifold 41*a* supplies the ink to the plurality of first individual channels 49*a*, and the supply manifold 41*b* supplies the ink to the plurality of second individual channels 49*b*. As depicted in FIG. 3, the two supply manifolds 41 are formed to range from the channel member 21 to the second manifold member 24. Further, the ink, which outflows from the supply manifold 41*a*, flows into the return manifold 42*a* via the plurality of first individual channels 49*a*. The ink, which outflows from the supply manifold 41*b*, flows into the return manifold 42*b* via the plurality of second individual channels 49*b*. In other words, the two return manifolds 42 are configured to outflow the liquid from the two supply manifolds 41 respectively. As depicted in FIG. 3, the two return manifolds 42 are formed to range from the channel member 21 to the first manifold member 23.

As depicted in FIG. 2, each of the two supply manifolds 41 extends in the conveying direction. The two supply manifolds 41 are aligned in the scanning direction at the central portion in the scanning direction of the ink-jet head 3. As for the two supply manifolds 41*a*, 41*b* which are aligned in the scanning direction, the supply manifold 41*a* is positioned on one side (lower side as viewed in FIG. 2) in the scanning direction, and the supply manifold 41*b* is positioned on the other side (upper side as viewed in FIG. 2) in the scanning direction.

As described in detail later on, the two supply manifolds 41*a*, 41*b* are connected by the bypass channel 48*a* which extends in the main scanning direction. In this context, as depicted in FIG. 2, it is assumed that an imaginary straight line, which intersects the bypass channel 48*a* and which extends in the conveying direction (direction orthogonal to the main scanning direction), is designated as "straight line C1". The two supply manifolds 41*a*, 41*b* are in line symmetry with respect to the straight line C1.

As depicted in FIG. 2, each of the two return manifolds 42 extends in the conveying direction. The two return manifolds 42 are aligned in the scanning direction at the central portion in the scanning direction of the ink-jet head 3. As for the two return manifolds 42*a*, 42*b* which are aligned in the scanning direction, the return manifold 42*a* is positioned on one side (lower side as viewed in FIG. 2) in the scanning direction, and the return manifold 42*b* is positioned on the other side (upper side as viewed in FIG. 2) in the scanning direction.

As described in detail later on, the two return manifolds 42*a*, 42*b* are connected by the bypass channel 48*b* which extends in the main scanning direction. In this context, as depicted in FIG. 2, it is assumed that the straight line, which intersects the bypass channel 48*b* and which extends in the conveying direction (direction orthogonal to the main scanning direction), is designated as "straight line C2". The two return manifolds 42*a*, 42*b* are in line symmetry with respect to the straight line C2.

The length of the supply manifold 41 in the conveying direction is shorter than the length of the return manifold 42 in the conveying direction. The position of the end portion of the supply manifold 41, which is provided on the upstream side (left side as viewed in FIG. 2) in the conveying direction as viewed in the top view, is the same as that of the return manifold 42. The return manifold 42 extends up to the downstream side (right side as viewed in FIG. 2) in the conveying direction as compared with the supply manifold 41.

As depicted in FIG. 3, the shape of cross section of each of the two supply manifolds 41*a*, 41*b*, which is taken along a plane orthogonal to the conveying direction, has the upper end thereof which is bent toward the center in the scanning direction of the ink-jet head 3. The supply manifold 41*a* is arranged on the return manifold 42*a* such that the supply manifold 41*a* covers the other side (right side as viewed in FIG. 3) of the return manifold 42*a* in the scanning direction and the upper side of the return manifold 42*a*. The supply manifold 41*b* is arranged on the return manifold 42*b* such that the supply manifold 41*b* covers one side (left side as viewed in FIG. 3) of the return manifold 42*b* in the scanning direction and the upper side of the return manifold 42*b*.

The supply port 61 ("supply channel" of the present disclosure) is connected to the end portion of the supply manifold 41*a* on the downstream side (right side as viewed in FIG. 2) in the conveying direction. Similarly, the supply port 62 ("supply channel" of the present disclosure) is connected to the end portion of the supply manifold 41*b* on the downstream side (right side as viewed in FIG. 2) in the conveying direction. The supply ports 61, 62 are positioned respectively on the upstream side in the flow direction of the ink as compared with the two supply manifolds 41. The supply ports 61, 62 supply the ink to the two supply manifolds 41 respectively.

Each of the supply ports 61, 62 is open on the upper surface of the second manifold member 24. As depicted in FIG. 2, each of the supply ports 61, 62 has a circular shape as viewed in a top view. In this context, the diameter D1 of the supply port 61 is mutually different from the diameter D2 of the supply port 62. Accordingly, the resistance value R1 of the channel ranging from the supply port 61 to the supply manifold 41*a* is mutually different from the resistance value R2 of the channel ranging from the supply port 62 to the supply manifold 41*b*. Specifically, D1>D2 is given, and R1<R2 is given.

The return port 63 ("return channel" of the present disclosure) is connected to the end portion of the return manifold 42*a* on the downstream side (right side as viewed in FIG. 2) in the conveying direction. Similarly, the return port 64 ("return channel" of the present disclosure) is connected to the end portion of the return manifold 42*b* on the downstream side (right side as viewed in FIG. 2) in the conveying direction. The return ports 63, 64 are positioned respectively on the downstream side in the flow direction of the ink as compared with the two return manifolds 42. The ink contained in the two return manifolds 42 flows into the return ports 63, 64 respectively.

The return ports 63, 64 are open on the upper surface of the second manifold member 24. As depicted in FIG. 2, each of the return ports 63, 64 has a circular shape as viewed in a top view. In this context, the diameter D3 of the return port 63 is mutually different from the diameter D4 of the return port 64. Accordingly, the resistance value R3 of the channel ranging from the return manifold 42*a* to the return port 63 is mutually different from the resistance value R4 of the channel ranging from the return manifold 42 to the return port 64. Specifically, D3>D4 is given, and R3<R4 is given.

The supply manifold 41*a* and the supply manifold 41*b* are communicated with each other by the bypass channel 48*a* without passing through the plurality of first individual channels 49*a* and the plurality of second individual channels 49*b*. As depicted in FIG. 2, the bypass channel 48*a* mutually connects the end portions on the upstream side (left side as viewed in FIG. 2) in the conveying direction of the supply manifold 41*a* and the supply manifold 41*b*. That is, the bypass channel 48*a* is positioned at the end portion disposed on the side opposite to the end portion disposed on the downstream side (right side as viewed in FIG. 2) in the conveying direction at which the supply ports 61, 62 of the supply manifold 41*a* and the supply manifold 41*b* are connected.

Further, the return manifold 42*a* and the return manifold 42*b* are communicated with each other by the bypass channel 48*b* without passing through the plurality of first individual channels 49*a* and the plurality of second individual channels 49*b*. As depicted in FIG. 2, the bypass channel 48*b* connects the end portion on the upstream side (left side as viewed in FIG. 2) in the conveying direction of the return manifold 42*a* and the end portion on the upstream side in the conveying direction of the return manifold 42*b*. That is, the bypass channel 48*b* is positioned at the end portion disposed on the side opposite to the end portion disposed on the downstream side (right side as viewed in FIG. 2) in the conveying direction at which the return ports 63, 64 of the return manifold 42*a* and the return manifold 42*b* are connected.

As depicted in FIG. 3, the channel member 21 includes the first individual channel group 50*a* which includes the plurality of first individual channels 49*a* and the second individual channel group 50*b* which includes the plurality of second individual channels 49*b*. The plurality of first individual channels 49*a* have the pressure chambers 43, the communication channels 44, the descender channels 45, the communication channels 46, and the first discharge ports 47*a* respectively. The plurality of second individual channels 49*b* have the pressure chambers 43, the communication channels 44, the descender channels 45, the communication channels 46, and the second discharge ports 47*b* respectively.

The plurality of pressure chambers 43 are arranged at positions at which the plurality of pressure chambers 43 are not overlapped with the supply manifolds 41 and the return manifolds 42 as viewed in a top view. More specifically, the plurality of pressure chambers 43 are positioned respectively on the both sides (upper side and lower side as viewed in FIG. 2) of the supply manifolds 41 and the return manifolds 42 in relation to the scanning direction.

As depicted in FIG. 2, the plurality of pressure chambers 43, which are positioned on the both sides of the supply manifolds 41 and the return manifolds 42 in relation to the scanning direction respectively, are arranged at equal intervals in the conveying direction. In this case, the plurality of first individual channels 49*a* include the pressure chambers 43 which are positioned on one side (lower side as viewed in FIG. 2) of the supply manifolds 41 and the return manifolds 42 in relation to the scanning direction respectively. The first individual channel group 50*a* is constructed by the plurality of first individual channels 49*a*. Further, the plurality of second individual channels 49*b* include the pressure chambers 43 which are positioned on the other side (upper side as viewed in FIG. 2) of the supply manifolds 41 and the return manifolds 42 in relation to the scanning direction respectively. The second individual channel group 50*b* is constructed by the plurality of second individual channels 49*b*.

The respective pressure chambers 43, which belong to the first individual channel group 50*a*, are communicated with the supply manifold 41*a* via the communication channels 44 respectively. That is, the supply manifold 41*a* is provided commonly for the first individual channel group 50*a*. The communication channel 44 as described above is provided for every pressure chamber 43. The communication channel 44 is connected to the end portion disposed on the other side (upper side as viewed in FIG. 2) of the pressure chamber 43 in relation to the scanning direction.

The respective pressure chambers 43, which belong to the second individual channel group 50*b*, are communicated with the supply manifold 41*b* via the communication channels 44 respectively. That is, the supply manifold 41*b* is provided commonly for the second individual channel group 50*b*. The communication channel 44 as described above is provided for every pressure chamber 43. The communication channel 44 is connected to the end portion disposed on one side (lower side as viewed in FIG. 2) of the pressure chamber 43 in relation to the scanning direction.

As depicted in FIG. 3, the descender channel 45 is positioned between the pressure chamber 43 and the first discharge port 47*a* or the second discharge port 47*b* in relation to the upward-downward direction. The descender channel 45 is connected to the end portion of the pressure chamber 43 disposed on the side opposite to the side on which the communication channel 44 is connected in relation to the scanning direction. That is, as for the pressure chamber 43 belonging to the first individual channel group 50*a*, the descender channel 45 is connected to the end portion disposed on one side (lower side as viewed in FIG. 2) in the scanning direction. As for the pressure chamber 43 belonging to the second individual channel group 50*b*, the descender channel 45 is connected to the end portion disposed on the other side (upper side as viewed in FIG. 2) in the scanning direction.

As depicted in FIG. 3, the respective descender channels 45, which belong to the first individual channel group 50*a*, are communicated with the return manifold 42*a* via the communication channels 46 respectively. That is, the return manifold 42*a* is provided commonly for the first individual channel group 50*a*. The communication channel 46 as described above is provided for each of the descender channels 45 belonging to the first individual channel group 50*a*.

Similarly, the respective descender channel 45, which belong to the second individual channel group 50*b*, are communicated with the return manifold 42*b* via the communication channels 46 respectively. That is, the return manifold 42*b* is provided commonly for the second individual channel group 50*b*. The communication channel 46 as described above is provided for each of the descender channels 45 belonging to the second individual channel group 50*b*.

Each of the first discharge port 47*a* and the second discharge port 47*b* is formed on the lower surface of the channel member 21. As depicted in FIG. 2, the plurality of first discharge ports 47*a*, which belong to the first individual channel group 50*a*, are arranged at equal intervals in the conveying direction at the end portion of the channel member 21 disposed on one side (lower side as viewed in FIG. 2) in the scanning direction. The plurality of second discharge ports 47*b*, which belong to the second individual channel group 50*b*, are arranged at equal intervals in the conveying direction at the end portion of the channel member 21 disposed on the other side (upper side as viewed in FIG. 2) in the scanning direction. The arrangement pitches of the plurality of first discharge ports 47*a* are equal to the arrangement pitches of the plurality of second discharge ports 47*b*. The position of each of the first discharge ports 47*a* in relation to the conveying direction is deviated by a half pitch from the position of each of the second discharge ports 47*b* in relation to the conveying direction.

As depicted in FIG. 3, the channel member 21 has five plates 31 to 35. The plates 31 to 35 are stacked in this order from the bottom. Each of the plates 31 to 35 has an identical outer shape. Each of the plates 31 to 35 has a rectangular shape which is lengthy in the conveying direction as viewed in a top view. The pressure chambers 43 are formed to range over the plates 34, 35 in the channel member 21. In other words, the pressure chambers 43 are open on the upper surface of the channel member 21. Further, the descender channels 45 are formed to range over the plates 32, 33. Further, as for the channel member 21, a part of the supply manifold 41 is formed to range over the plates 34, 35, and a part of the return manifold 42 is formed to range over the plates 32 to 35. In other words, each of the portion of the supply manifold 41 formed on the channel member 21 and the portion of the return manifold 42 formed on the channel member 21 is open on the upper surface of the channel member 21.

The vibration plate 22 has the same outer shape as those of the plates 31 to 35 as viewed in a top view. The vibration plate 22 is stacked on the upper surface of the channel member 21, i.e., on the upper surface of the plate 35. The vibration plate 22 covers the plurality of pressure chambers 43 included in the first individual channel 49*a* and the plurality of pressure chambers 43 included in the second individual channel 49*b* each of which is open on the upper surface of the channel member 21.

As depicted in FIG. 3, the vibration plate 22 has two filters 22*a* which are provided in the areas opposed to the portions of the supply manifolds 41 that are open on the upper surface of the channel member 21 respectively. Further, the vibration plate 22 has through-holes 22*b* which constitute parts of the return manifolds 42. The through-holes 22*b* are positioned in the areas opposed to the portions of the return manifolds 42 that are open on the upper surface of the channel member 21 respectively.

The common electrode 51, the piezoelectric member 52, and the individual electrodes 53, which are stacked in this order from the bottom, are positioned in the areas of the upper surface of the vibration plate 22 opposed to the plurality of pressure chambers 43. The common electrode 51 and the piezoelectric member 52 are provided for each of the plurality of pressure chambers 43 belonging to each of the first individual channel group 50*a* and the second individual channel group 50*b*. The common electrode 51 and the piezoelectric member 52 are provided to span the plurality of pressure chambers 43 belonging to each of the first individual channel group 50*a* and the second individual channel group 50*b*. The individual electrode 53 is provided for each of the pressure chambers 43. The individual electrode 53 is overlapped with each of the pressure chambers 43 as viewed in a top view. One individual electrode 53 and the portions of the common electrode 51 and the piezoelectric member 52 opposed to the individual electrode 53 constitute one piezoelectric element 25. That is, the piezoelectric element 25 is positioned for each of the pressure chambers 43 on the upper surface of the vibration plate 22.

The plurality of individual electrodes 53 are connected to unillustrated driver IC via unillustrated wiring members. The driver IC maintains the electric potential of the common electrode 51 at the ground electric potential, while the driver IC changes the electric potential of the individual electrode 53. Accordingly, the portions of the vibration plate 22 and the piezoelectric member 52, which are interposed by the individual electrode 53 and the pressure chamber 43, are deformed so that the portions protrude toward the pressure chamber 43. In accordance with the deformation, the volume of the pressure chamber 43 is decreased, and the pressure of the ink contained in the pressure chamber 43 is raised. The ink is discharged from the first discharge port 47*a* or the second discharge port 47*b* communicated with the pressure chamber 43.

As depicted in FIG. 3, the first manifold member 23 is stacked at the position which is different from the position of the piezoelectric element 25 on the upper surface of the vibration plate 22. Further, the second manifold member 24 is stacked on the upper surface of the first manifold member 23. As depicted in FIG. 2, the lengths in the conveying direction of the first manifold member 23 and the second manifold member 24 are the same as those of the channel member 21 and the vibration plate 22. The lengths in the scanning direction of the first manifold member 23 and the second manifold member 24 are shorter than those of the channel member 21 and the vibration plate 22. The first manifold member 23 and the second manifold member 24 are positioned at the central portions in the scanning direction of the channel member 21 and the vibration plate 22.

Figure 4A:
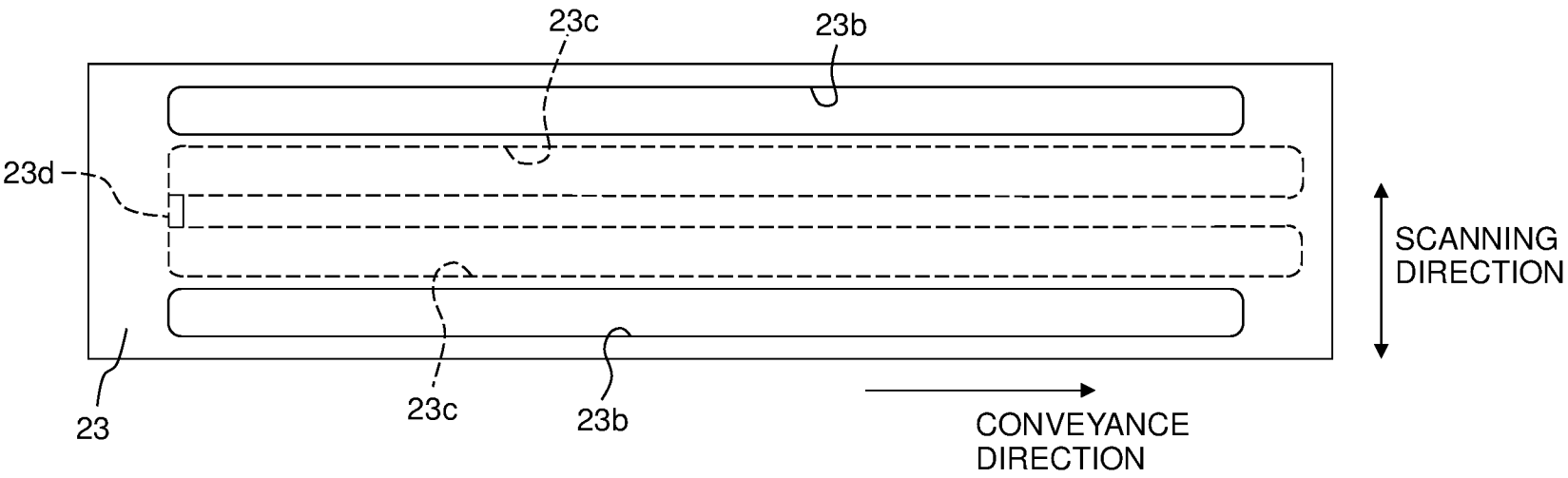
FIG. 4A depicts a plan view illustrating a first manifold member.

As depicted in FIGS. 3 and 4A, the first manifold member 23 has two through-holes 23*b* which penetrate in the upward-downward direction, and two grooves 23*c* and a groove 23*d* ("second groove" of the present disclosure) which are formed on the lower surface of the first manifold member 23 (surface facing the vibration plate 22). The two through-holes 23*b* form parts of the supply manifolds 41*a*, 41*b* respectively. The two through-holes 23*b* extend in the conveying direction, and the two through-holes 23*b* are provided in the areas opposed to the two filters 22 provided for the vibration plate 22 respectively. The two grooves 23*c* constitute parts of the return manifolds 42*a*, 42*b* respectively. The two grooves 23*c* extend in the conveying direction, and the two grooves 23*c* are provided in the areas opposed to the two through-holes 22*b* provided for the vibration plate 22 respectively.

Figure 5:
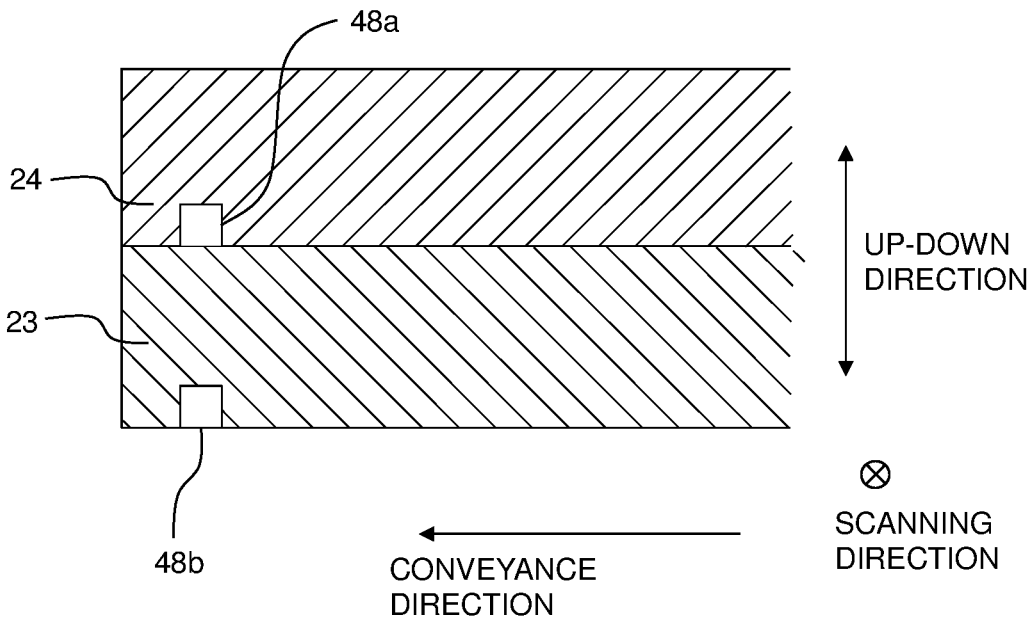
FIG. 5 depicts a partial sectional view illustrating the first and second manifold members taken along a line V-V depicted in FIG. 2.

The groove 23*d* mutually connects the end portions of the two grooves 23*c* disposed on the upstream side (left side as viewed in FIG. 4A) in the conveying direction. As depicted in FIG. 3, the depth of the groove 23*d* is shallower than the depth of the groove 23*c*. The bypass channel 48*b* is defined by the groove 23*d* which is provided for the first manifold member 23 and the upper surface of the vibration plate 22 (surface facing the first manifold member 23). In this case, as depicted in FIG. 5, the shape of the cross section of the bypass channel 48*b*, which is orthogonal to the flow direction of the ink (scanning direction), is rectangular.

Figure 4B:
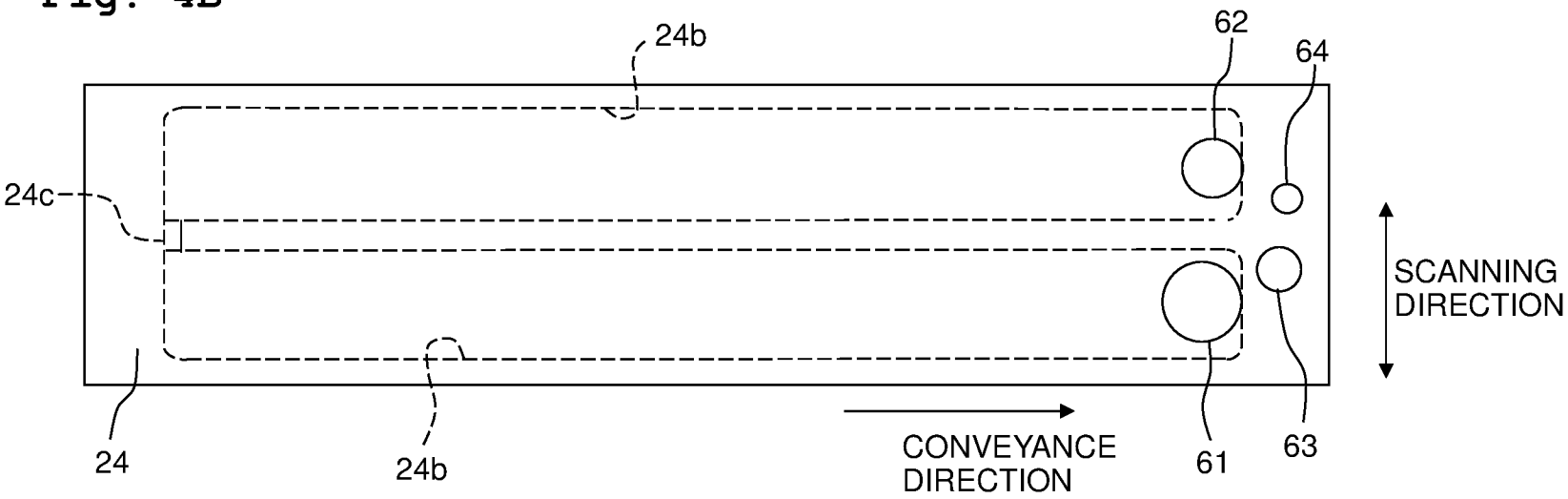
FIG. 4B depicts a plan view illustrating a second manifold member.

As depicted in FIGS. 3 and 4B, the second manifold member 24 has two grooves 24*b*, 24*c* ("first grooves" of the present disclosure) which are formed on the lower surface of the second manifold member 24 (surface facing the first manifold member 23). The two grooves 24*b* form parts of the supply manifolds 41*a*, 41*b* respectively. The two grooves 24*b* extend in the conveying direction. The two grooves 24*b* are positioned over or above the through-holes 23*b* and the grooves 23*c* provided for the first manifold member 23. More specifically, the grooves 24*b* are provided to span the areas opposed to the through-holes 23*b* and the areas opposed to the grooves 23*c*.

The groove 24*c* mutually connects the end portions of the two grooves 24*b* disposed on the upstream side (left side as viewed in FIG. 4B) in the conveying direction. As depicted in FIG. 3, the depth of the groove 24*c* is shallower than the depth of the groove 24*b*. The bypass channel 48*a* is defined by the groove 24*c* which is provided for the second manifold member 24 and the upper surface of the first manifold member 23 (surface facing the second manifold member 24). In this case, as depicted in FIG. 5, the shape of the cross section of the bypass channel 48*a*, which is orthogonal to the flow direction of the ink (scanning direction), is rectangular.

That is, the supply manifold 41 is formed to range from the plate 34 of the channel member 21 to the second manifold member 24. Then, the filter 22*a*, which is provided for the vibration plate 22, is positioned in the supply manifold 41. The ink contained in the supply manifold 41 passes through the filter 22*a* in the direction directed from the upward to the downward. Further, the return manifold 42 is formed to range from the plate 32 of the channel member 21 to the first manifold member 23.

As depicted in FIGS. 2 and 4B, the supply ports 61, 62 are formed respectively at the portions of the upper wall of the second manifold member 24 opposed to the end portions of the supply manifolds 41*a*, 41*b* disposed on the downstream side (right side as viewed in FIG. 2) in the conveying direction. The supply manifolds 41*a*, 41*b* are communicated with the ink tank 90 respectively via tubes (not depicted) attached to the supply ports 61, 62. The supply pumps 91, 92, which feed the ink contained in the ink tank 90 to the two supply manifolds 41 via the supply ports 61, 62, are provided respectively at intermediate positions of the channels between the ink tank 90 and the supply ports 61, 62.

The return ports 63, 64 are formed respectively at the portions of the upper wall of the second manifold member 24 opposed to the end portions of the return manifolds 42*a*, 42*b* disposed on the downstream side (right side as viewed in FIG. 2) in the conveying direction. The return manifolds 42*a*, 42*b* are communicated with the ink tank 90 respectively via tubes (not depicted) attached to the return ports 63, 64. The return pumps 93, 94, which suck the ink contained in the two return manifolds 42 respectively via the return ports 63, 64 and which feed the ink to the ink tank 90, are provided respectively at intermediate positions of the channels between the ink tank 90 and the return ports 63, 64.

In this case, as described above, the resistance value R1 of the channel ranging from the supply port 61 to the supply manifold 41*a* is smaller than the resistance value R2 of the channel ranging from the supply port 62 to the supply manifold 41*b*. Further, the resistance value R3 of the channel ranging from the return manifold 42*a* to the return port 63 is smaller than the resistance value R4 of the channel ranging from the return manifold 42*b* to the return port 64. Therefore, if the numbers of revolutions of the supply pumps 91, 92 are the same as the numbers of revolutions the return pumps 93, 94, $|P1|>|P2|$ is given assuming that the pressure of the supply manifold 41*a* is the first pressure P1, the pressure of the supply manifold 41*b* is the second pressure P2, the pressure of the return manifold 42*a* is the third pressure P3 ($P3=-P1$), and the pressure of the return manifold 42*b* is the fourth pressure P4 ($P4=-P2$).

Next, an explanation will be made about the circulation of the ink between the ink-jet head 3 and the ink tank 90. At first, when the supply pump 91 is driven, the ink, which is stored in the ink tank 90, thereby flows into the supply manifold 41*a* via the supply port 61. When the supply pump 92 is driven, the ink, which is stored in the ink tank 90, thereby flows into the supply manifold 41*b* via the supply port 62.

In this case, as described above, the pressure of the supply manifold 41*a* is the first pressure P1, and the pressure of the return manifold 42*a* is the third pressure −P1. Therefore, a part of the ink, which is stored in the supply manifold 41*a*, passes through the filter 22*a*, and then the part of the ink flows into the return manifold 42*a* via the first individual channel 49*a*. Further, the pressure of the supply manifold 41*b* is the second pressure P2, and the pressure of the return manifold 42*b* is the fourth pressure −P2. Therefore, a part of the ink, which is stored in the supply manifold 41*b*, passes through the filter 22*a*, and then the part of the ink flows into the return manifold 42*b* via the second individual channel 49*b*.

Further, as described above, the first pressure P1 of the supply manifold 41*a* is larger than the second pressure P2 of the supply manifold 41*b*. Therefore, a part of the ink, which is stored in the supply manifold 41*a*, flows into the supply manifold 41*b* via the bypass channel 48*a*. Further, the absolute value of the third pressure −P1 of the return manifold 42*a* is larger than the absolute value of the fourth pressure −P2 of the return manifold 42*b*. Therefore, a part of the ink, which is contained in the return manifold 42*b*, flows into the return manifold 42*a* via the bypass channel 48*b*.

The ink contained in the return manifold 42*a* returns to the ink tank 90 via the return port 63 by driving the return pump 93, and the ink contained in the return manifold 42*b* returns to the ink tank 90 via the return port 64 by driving the return pump 94.

Effect of First Embodiment

As described above, the ink-jet head 3 of the embodiment described above includes the first individual channel group 50*a* which includes the plurality of first individual channels 49*a*; the second individual channel group 50*b* which includes the plurality of second individual channels 49*b*; the two supply manifolds 41*a*, 41*b* which are provided for the first individual channel group 50*a* and the second individual channel group 50*b* respectively; the two return manifolds 42*a*, 42*b* which are provided for the first individual channel group 50*a* and the second individual channel group 50*b* respectively; and the bypass channels 48*a*, 48*b* each of which is provided to make communication in relation to the combination of the two supply manifolds 41*a*, 41*b* and the combination of the two return manifolds 42*a*, 42*b*, without passing through the plurality of first individual channels 49*a* and the plurality of second individual channels 49*b*. Then, the relationship of |P1|>|P2| is fulfilled by the first pressure P1 of the supply manifold 41*a*, the second pressure P2 of the supply manifold 41*b*, the third pressure −P1 of the return manifold 42*a*, and the fourth pressure −P2 of the return manifold 42*b*. The relationship of |P1|>|P2| is fulfilled, and hence the ink can be simultaneously moved between the two supply manifolds 41*a*, 41*b*, between the two return manifolds 42*a*, 42*b*, between the supply manifold 41*a* and the return manifold 42*a*, and between the supply manifold 41b and the return manifold 42*b*. Therefore, the bypass channels 48*a*, 48*b* can be used to move the ink between the supply manifolds 41*a*, 41*b* and between the return manifolds 42*a*, 42*b* without passing through the first individual channel 49*a* and the second individual channel 49 which have the relatively high flow resistances, while moving the ink between the supply manifold 41*a* and the return manifold 42*a* and between the supply manifold 41*b* and the return manifold 42*b*. Therefore, it is possible to sufficiently secure the circulating flow rate of the ink.

Further, in this embodiment, the resistance value R1 of the channel ranging from the supply port 61 to the supply manifold 41*a* is mutually different from the resistance value R2 of the channel ranging from the supply port 62 to the supply manifold 41*b*. Further, the resistance value R3 of the channel ranging from the return manifold 42*a* to the return port 63 is mutually different from the resistance value R4 of the channel ranging from the return manifold 42*b* to the return port 64. Therefore, the first pressure P1 of the supply manifold 41*a*, the second pressure P2 of the supply manifold 41*b*, the third pressure −P1 of the return manifold 42*a*, and the fourth pressure −P2 of the return manifold 42*b* can be allowed to fulfill the relationship of |P1|>|P2|.

Further, in this embodiment, the shapes of the cross sections of the bypass channels 48*a*, 48*b*, which are orthogonal to the flow direction of the ink, are rectangular. The attenuation coefficients of the bypass channels 48*a*, 48*b* are increased as compared with a case in which the cross-sectional shape is circular. Therefore, it is possible to sufficiently reduce the resonance in the supply manifold 41 and the return manifold 42 which are connected to the bypass channels 48*a*, 48*b*. Therefore, it is possible to avoid the decrease in the discharge characteristic of the ink to be discharged from the first discharge port 47*a* and the second discharge port 47*b*, which would be otherwise caused by the influence of the resonance.

Additionally, in this embodiment, the two supply manifolds 41*a*, 41*b* intersect the bypass channel 48*a*, and the two supply manifolds 41*a*, 41*b* are in line symmetry with respect to the straight line C1 which extends in the conveying direction. Further, the two return manifolds 42*a*, 42*b* intersect the bypass channel 48*b*, and the two return manifolds 42*a*, 42*b* are in line symmetry with respect to the straight line C2 which extends in the conveying direction. Accordingly, the characteristic is uniformized between the two supply manifolds 41 which are connected by the bypass channel 48*a*, and the characteristic is uniformized between the two return manifolds 42 which are connected by the bypass channel 48*b*. Therefore, it is possible to avoid the change in the discharge characteristics of the first discharge port 47*a* and the second discharge port 47*b*, and it is possible to suppress the occurrence of any unevenness in the image.

Further, in this embodiment, the supply ports 61, 62 are positioned respectively at the end portions of the two supply manifolds 41*a*, 41*b* disposed on the downstream side in the conveying direction, and the bypass channel 48*a*, which makes communication between the two supply manifolds 41*a*, 41*b*, is positioned at the end portion of each of the supply manifolds 41*a*, 41*b* disposed on the upstream side in the conveying direction. Therefore, the ink, which is supplied from the supply port 61 to the supply manifold 41*a*, flows into the supply manifold 41*b* via the bypass channel 48*a* which is positioned at the end portion of the supply manifold 41*a* disposed on the side opposite to the side on which the supply port 61 is positioned. Therefore, it is possible to reliably circulate the ink contained in the supply manifold 41.

Additionally, in this embodiment, the return ports 63, 64 are positioned respectively at the end portions of the two return manifolds 42*a*, 42*b* disposed on the downstream side in the conveying direction, and the bypass channel 48*b*, which makes communication between the two return manifolds 42*a*, 42*b*, is positioned at the end portion of each of the return manifolds 42*a*, 42*b* disposed on the upstream side in the conveying direction. Therefore, the ink, which flows from the return manifold 42*b* to the return manifold 42*a* via the bypass channel 48*b*, flows into the return port 63 which is positioned at the end portion of the return manifold 42*a* disposed on the side opposite to the side on which the bypass channel 48*b* is positioned. Therefore, it is possible to reliably circulate the ink contained in the return manifold 42.

Further, in this embodiment, the bypass channel 48*a* is constructed by the groove 24*c* which is provided on the lower surface of the second manifold member 24 and the upper surface of the first manifold member 23. Further, the bypass channel 48*b* is constructed by the groove 23*d* which is provided on the lower surface of the first manifold member 23 and the upper surface of the vibration plate 22. Therefore, it is possible to accurately form the bypass channels 48*a*, 48*b* by forming the grooves 24*c*, 23*d* by means of the etching.

As described above, the embodiment of the present disclosure has been explained on the basis of the drawings. However, it should be considered that the specified configuration is not limited to the embodiment as described above. The scope of the present disclosure is defined not only by the explanation of the embodiment described above but also by claims. Further, the scope of the present disclosure includes all changes or alterations within a range or meaning equivalent to claims.

Figure 6:
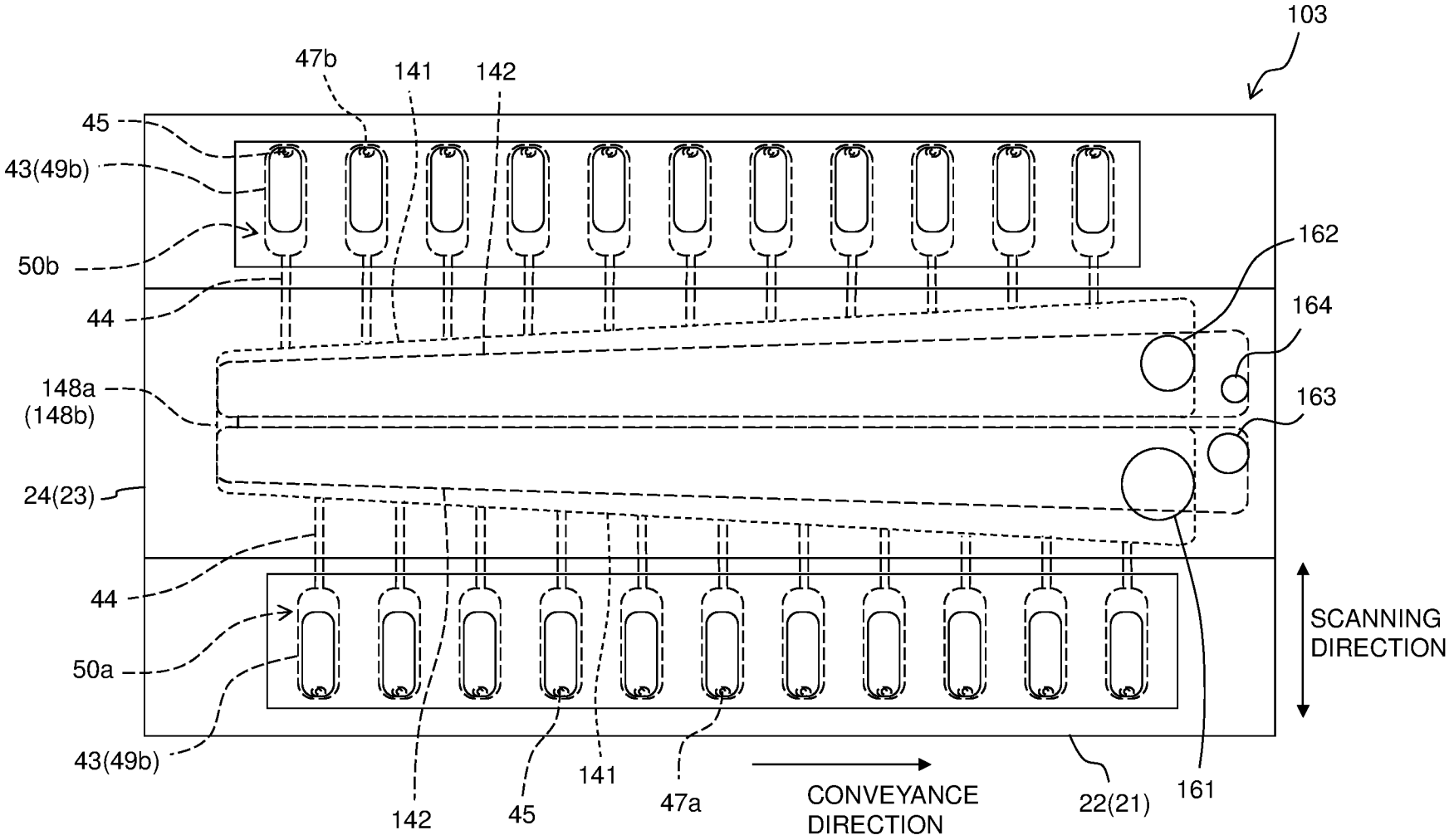
FIG. 6 depicts a plan view illustrating an ink-jet head according to a first modified embodiment.

As depicted in FIG. 6, in an ink-jet head 103 according to a first modified embodiment of the embodiment described above, the widths of supply manifolds 141 and return manifolds 142 in relation to the scanning direction are not constant. That is, the widths of the supply manifolds 141 in relation to the scanning direction are the largest at the end portions (end portions disposed on the downstream side in the conveying direction) on the side on which supply ports 161, 162 are provided in relation to the conveying direction, and the widths are gradually decreased at positions nearer to the end portions (end portions disposed on the upstream side in the conveying direction) on the side on which the bypass channel 148*a* is provided in relation to the conveying direction. Similarly, the widths of the return manifolds 142 in relation to the scanning direction are the largest at the end portions (end portions disposed on the downstream side in the conveying direction) on the side on which return ports 163, 164 are provided in relation to the conveying direction, and the widths are gradually decreased at positions nearer to the end portions (end portions disposed on the upstream side in the conveying direction) on the side on which the bypass channel 148*b* is provided in relation to the conveying direction.

The heights of the supply manifolds 141 and the return manifolds 142 are constant in relation to the conveying direction. Therefore, the cross-sectional area on the cross section (cross section orthogonal to the conveying direction) of the supply manifold 141, which is orthogonal to the flow direction of the ink via the bypass channel 148*a*, is gradually decreased toward the bypass channel 148*a*. Similarly, the cross-sectional area on the cross section (cross section orthogonal to the conveying direction) of the return manifold 142, which is orthogonal to the flow direction of the ink via the bypass channel 148*b*, is also gradually decreased toward the bypass channel 148*b*.

In this modified embodiment, in relation to the supply manifolds 141 and the return manifolds 142, the cross-sectional areas are more decreased on the planes orthogonal to the flow direction of the ink at positions nearer to the bypass channels 148*a*, 148*b*. Therefore, it is possible to suppress the occurrence of any stagnation of the ink in the vicinity of the bypass channels 148*a*, 148*b*. Therefore, it is possible to reliably circulate the ink contained in the ink-jet head 103, and it is possible to avoid any clogging at the first discharge port 47*a* and the second discharge port 47*b*.

In this modified embodiment, as for the supply manifolds 141 and the return manifolds 142, in relation to the conveying direction, the height is constant and the width in relation to the scanning direction is not constant. However, as for the supply manifolds 141 and the return manifolds 142, in relation to the conveying direction, it is also allowable that the width in relation to the scanning direction is constant and the height is not constant. In this case, the height of the supply manifold 141 is the highest at the end portion (end portion disposed on the downstream side in the conveying direction) on the side on which the supply port 161, 162 is provided in relation to the conveying direction, and the height of the supply manifold 141 is gradually lowered at positions nearer to the end portion (end portion disposed on the upstream side in the conveying direction) on the side on which the bypass channel 148*a* is provided in relation to the conveying direction. Similarly, the height of the return manifold 142 is the highest at the end portion (end portion disposed on the downstream side in the conveying direction) on the side on which the return port 163, 164 is provided in relation to the conveying direction, and the height of the return manifold 142 is gradually lowered at positions nearer to the end portion (end portion disposed on the upstream side in the conveying direction) on the side on which the bypass channel 148*b* is provided in relation to the conveying direction.

Further, in this modified embodiment, the cross-sectional areas of the supply manifold 141 and the return manifolds 142, which are provided on the cross sections (cross sections orthogonal to the conveying direction) orthogonal to the flow direction of the ink, are gradually decreased at positions nearer to the bypass channels 148*a*, 148*b*. However, it is also allowable that the cross-sectional areas of the supply manifold 141 and the return manifolds 142, which are provided on the cross sections orthogonal to the flow direction of the ink, are decreased in a stepwise manner at positions nearer to the bypass channels 148*a*, 148*b*.

Further, in the embodiment described above, the diameter D1 of the supply port 61 is mutually different from the diameter D2 of the supply port 62, and the resistance value R1 of the channel ranging from the supply port 61 to the supply manifold 41*a* is mutually different from the resistance value R2 of the channel ranging from the supply port 62 to the supply manifold 41*b*. Further, the diameter D3 of the return port 63 is mutually different from the diameter D4 of the return port 64, and the resistance value R3 of the channel ranging from the return manifold 42*a* to the return port 63 is mutually different from the resistance value R4 of the channel ranging from the return manifold 42*b* to the return port 64. However, it is also allowable to change the shapes of the two supply channels other than the supply ports 61, 62 positioned on the upstream side in the flow direction of the ink as compared with the supply manifolds 41*a*, 41*b* respectively so that the resistance values R1, R2 are different from each other. Similarly, it is also allowable to change the shapes of the two return channels other than the return ports 63, 64 positioned on the downstream side in the flow direction of the ink as compared with the supply manifolds 41*a*, 41*b* so that the resistance values R3, R4 are different from each other. Further, it is also allowable that a mechanism for changing the flow resistance is provided for each of the supply channels and the return channels so that the flow resistances of the two supply channels and the two return channels are changeable.

Additionally, in the embodiment described above, each of the supply pumps 91, 92 and the return pumps 93, 94 is driven at the same predetermined number of revolutions. Further, the resistance value R1 of the channel ranging from the supply port 61 to the supply manifold 41*a* is mutually different from the resistance value R2 of the channel ranging from the supply port 62 to the supply manifold 41*b*. The resistance value R3 of the channel ranging from the return manifold 42*a* to the return port 63 is also mutually different from the resistance value R4 of the channel ranging from the return manifold 42*b* to the return port 64. Then, $|P1|>|P2|$ is given assuming that the pressure of the supply manifold 41*a* is the first pressure P1, the pressure of the supply manifold 41*b* is the second pressure P2, the pressure of the return manifold 42*a* is the third pressure −P1, and the pressure of the return manifold 42*b* is the fourth pressure −P2. However, the resistance values R1, R2 may be identical with each other, and the resistance values R3, R4 may be identical with each other.

That is, for example, if the resistance values R1, R2 are identical with each other, and the resistance values R3, R4 are identical with each other, then the controller 100 controls the numbers of revolutions of the supply pumps 91, 92 and the return pumps 93, 94 such that the relationship of |P1|>|P2| is satisfied. Specifically, the number of revolutions of the supply pump 91 is made larger than the number of revolutions of the supply pump 92, and the number of revolutions of the return pump 93 is made larger than the number of revolutions of the return pump 94. Further, it is also allowable that a plurality of pumps for feeding the ink to the respective supply manifolds 41 are provided respectively, a plurality of pumps for sucking the ink from the respective return manifolds 42 are provided respectively, and the controller 100 controls the number of the pumps to be driven.

Further, when the numbers of revolutions of the supply pumps 91, 92 and the return pumps 93, 94 are controlled by the controller 100, and the flow resistances of the two supply channels and the two return channels are controlled, then it is also allowable the controller 100 to control the numbers of revolutions of the supply pumps 91, 92 and the return pumps 93, 94 such that the absolute values of the first pressure P1, the second pressure P2, the third pressure P3 (=−P1), and the fourth pressure P4 (P4=−P2) are simultaneously increased. Accordingly, the differential pressure between the supply manifold 41*a* and the return manifold 42*a* which are provided commonly for the first individual channel group 50*a* and the differential pressure between the supply manifold 41*b* and the return manifold 42*b* which are provided commonly for the second individual channel group 50*b* are increased. Therefore, it is possible to increase the amount of circulation of the ink between the supply manifold 41*a* and the return manifold 42*a* which are provided commonly for the first individual channel group 50*a* and the amount of circulation of the ink between the supply manifold 41*b* and the return manifold 42*b* which are provided commonly for the second individual channel group 50*b*.

Further, when the numbers of revolutions of the supply pumps 91, 92 and the return pumps 93, 94 are controlled by the controller 100, and the flow resistances of the two supply channels and the two return channels are controlled, then it is also allowable the controller 100 to control the numbers of revolutions of the supply pumps 91, 92 and the return pumps 93, 94 such that the absolute values of the first pressure P1 and the third pressure −P1 are increased while maintaining the second pressure P2 and the fourth pressure −P2. Accordingly, the differential pressure between the supply manifold 41*a* and the return manifold 42*a* which are provided commonly for the first individual channel group 50*a*, the differential pressure between the two supply manifolds 41*a*, 41*b*, and the differential pressure between the two return manifolds 42*a*, 42*b* are increased. Therefore, it is possible to increase the amount of circulation of the ink between the supply manifold 41*a* and the return manifold 42*a* which are provided commonly for the first individual channel group 50*a*, the amount of circulation of the ink between the two supply manifolds 41*a*, 41*b*, and the amount of circulation of the ink between the two return manifolds 42*a*, 42*b*.

Additionally, in the embodiment described above, such a case has been explained that the bypass channel 48*a* which mutually communicates the two supply manifolds 41 and the bypass channel 48*b* which mutually communicates the two return manifolds 42 are provided. However, it is allowable that only any one of the bypass channel 48*a* and the bypass channel 48*b* is provided.

Further, in the embodiment described above, such a case has been explained that the shape of the cross section, which is taken along the plane orthogonal to the scanning direction as the flow direction of the ink of the bypass channel 48*a*, 48*b*, is rectangular. However, there is no limitation thereto. For example, the cross-sectional shape of the bypass channel 48*a*, 48*b* may be circular.

Further, in the embodiment described above, such a case has been explained that the two supply manifolds 41*a*, 41*b* are in line symmetry with respect to the straight line C1, and the two return manifolds 42*a*, 42*b* are in line symmetry with respect to the straight line C2. However, it is also allowable that the two supply manifolds 41*a*, 41*b* are not in line symmetry, and the two return manifolds 42*a*, 42*b* are not in line symmetry.

Additionally, in the embodiment described above, such a case has been explained that the supply ports 61, 62 are positioned respectively at the end portions of the two supply manifolds 41*a*, 41*b* disposed on the downstream side in the conveying direction, and the bypass channel 48*a* is positioned at the end portions of the respective supply manifolds 41*a*, 41*b* disposed on the upstream side in the conveying direction. However, there is no limitation thereto. It is preferable that the distance between the supply ports 61, 62 and the bypass channel 48*a* in relation to the conveying direction is not less than a half of the length of the supply manifold 41*a*, 41*b* in the conveying direction. However, the distance between the supply ports 61, 62 and the bypass channel 48*a* in relation to the conveying direction may be shorter than the length of the supply manifold 41*a*, 41*b* in the conveying direction. Similarly, it is preferable that the distance between the return ports 63, 64 and the bypass channel 48*b* in relation to the conveying direction is not less than a half of the length of the return manifold 42*a*, 42*b* in the conveying direction. However, the distance between the return ports 63, 64 and the bypass channel 48*b* in relation to the conveying direction may be shorter than the length of the return manifold 42*a*, 42*b* in the conveying direction.

Further, in the embodiment described above, such a case has been explained that the bypass channel 48*a* is constructed by the groove 24*c* which is provided on the lower surface of the second manifold member 24 and the upper surface of the first manifold member 23, and the bypass channel 48*b* is constructed by the groove 23*d* which is provided on the lower surface of the first manifold member 23 and the upper surface of the vibration plate 22. However, there is no limitation thereto. That is, for example, the bypass channel 48*a* may be constructed by a through-hole which penetrates in the scanning direction through the walls that partition the supply manifolds 41*a*, 41*b*. Further, the bypass channel 48*b* may be constructed by a through-hole which penetrates in the scanning direction through the walls that partition the return manifolds 42*a*, 42*b*.

Further, in the embodiment described above, such a case has been explained that one bypass channel 48*a* is provided for the supply manifolds 41*a*, 41*b*. However, there is no limitation thereto. A plurality of bypass channels 48*a* for mutually communicating the supply manifolds 41*a*, 41*b* may be provided. Similarly, a plurality of bypass channels 48*b* for mutually communicating the return manifolds 42*a*, 42*b* may be provided as well.

The actuator is not limited to the piezoelectric actuator based on the use of the piezoelectric element. It is also allowable to use those of the other systems (for example, the thermal system based on the use of the heat-generating element and the electrostatic system based on the use of the electrostatic force).

The recording system of the printer 1 is not limited to the serial system. It is also allowable to use the line system which is lengthy in the widthwise direction of the recording paper P and which discharges the ink from nozzles of a head having a fixed position.

The liquid, which is discharged from the nozzles, is not limited to the ink. It is allowable to use any arbitrary liquid (for example, a processing liquid for coagulating or depositing the component contained in the ink). Further, the discharge object is not limited to the recording paper P, which may be, for example, cloth, substrate or the like.

The present disclosure is not limited to the printer. The present disclosure is also applicable, for example, to facsimiles, copying machines, and multifunction machines. Further, the present disclosure is also applicable to any liquid discharge apparatus used for any way of use other than the recording of the image (for example, a liquid discharge apparatus for forming a conductive pattern by discharging a conductive liquid to a substrate).

What is claimed is:

1. A liquid discharge head comprising:

a channel unit including:

a first individual channel group including a plurality of first individual channels;

a second individual channel group including a plurality of second individual channels;

four manifolds including two supply manifolds corresponding to the first individual channel group and the second individual channel group respectively, and two return manifolds corresponding to the first individual channel group and the second individual channel group respectively, the two supply manifolds being configured to supply a liquid to the plurality of first individual channels and the plurality of second individual channels, and the two return manifolds being configured to outflow the liquid from the two supply manifolds; and a bypass channel communicating with the two supply manifolds or with the two return manifolds, without passing through the plurality of first individual channels or the plurality of second individual channels, wherein a relationship of $|P1|>|P2|$ is satisfied, wherein P1 is a first pressure of the supply manifold provided commonly for the first individual channel group, P2 is a second pressure of the supply manifold provided commonly for the second individual channel group, −P1 is a third pressure of the return manifold provided commonly for the first individual channel group, and −P2 is a fourth pressure of the return manifold provided commonly for the second individual channel group.

2. The liquid discharge head according to claim 1, wherein the channel unit further comprises:

two supply channels positioned upstream of the two supply manifolds in a flow direction of the liquid; and two return channels positioned downstream of the two return manifolds in the flow direction of the liquid, wherein the bypass channel is included in bypass channels, and the bypass channels connect between the two supply manifolds and between the two return manifolds, and wherein a resistance value of a channel ranging from one of the two supply channels to one of the two supply manifolds is different from a resistance value of a channel ranging from the other of the two supply channels to the other of the two supply manifolds.

3. The liquid discharge head according to claim 1, wherein a shape of a cross section of the bypass channel, which is orthogonal to the flow direction of the liquid, is rectangular.

4. The liquid discharge head according to claim 1, wherein two manifolds of the four manifolds, to which the bypass channel is connected, has a cross-sectional area of a cross section that is orthogonal to the flow direction of the liquid, and the cross-sectional area of the two manifolds is gradually decreased toward the bypass channel.

5. The liquid discharge head according to claim 1, wherein the bypass channel extends in a first direction, and wherein two manifolds, of the four manifolds are in line symmetry with respect to a straight line which intersects the bypass channel and which is orthogonal to the first direction.

6. The liquid discharge head according to claim 1, wherein the plurality of first individual channels each includes a first discharge port, wherein the plurality of second individual channels each includes a second discharge port, wherein the channel unit further comprises two supply ports configured to supply the liquid to the two supply manifolds, wherein the plurality of first discharge ports and the plurality of second discharge ports are arranged in a second direction, and wherein a distance in the second direction between the supply port and the bypass channel is not less than a half of a length of each of the two supply manifolds in the second direction.

7. The liquid discharge head according to claim 1, wherein the plurality of first individual channels each includes a first discharge port, wherein the plurality of second individual channels each includes a second discharge port, wherein the channel unit further comprises two return ports into which the liquid contained in the two return manifolds flows, wherein the plurality of first discharge ports and the plurality of second discharge ports are arranged in a second direction, and wherein a distance in the second direction between the return port and the bypass channel is not less than a half of a length of the return manifold in the second direction.

8. The liquid discharge head according to claim 1, wherein the channel unit further comprises:

a channel member including the first individual channel group and the second individual channel group;

a vibration plate covering at least a part of the first individual channel and at least a part of the second individual channel;

a first manifold member including parts of the two supply manifolds and the two return manifolds; and a second manifold member including parts of the two supply manifolds, and wherein the channel member, the vibration plate, the first manifold member, and the second manifold member are stacked in a third direction in this order.

9. The liquid discharge head according to claim 8, wherein the second manifold member includes a first groove formed on a surface of the second manifold member facing the first manifold member, and wherein the first groove and a surface of the first manifold member facing the second manifold member defines the bypass channel.

10. The liquid discharge head according to claim 8, wherein a second groove is formed on a surface of the first manifold member facing the vibration plate, and wherein the second groove and a surface of the vibration plate facing the first manifold member define the bypass channel connecting between the two return manifolds, includes.

11. A liquid discharge apparatus comprising:

the liquid discharge head as defined in claim 1;

two supply pumps configured to feed the liquid into the two supply manifolds;

two return pumps configured to suck the liquid contained in the two return manifolds; and a controller configured to control the two supply pumps and the two return pumps, wherein the controller is configured to control numbers of revolutions of the two supply pumps and the two return pumps such that a relationship of $|P1|>|P2|$ is satisfied.

12. The liquid discharge apparatus according to claim 11, wherein the controller controls the numbers of revolutions of the two supply pumps and the two return pumps such that absolute values of the first pressure, the second pressure, the third pressure, and the fourth pressure are simultaneously increased.

13. The liquid discharge apparatus according to claim 11, wherein the controller controls the numbers of revolutions of the two supply pumps and the two return pumps such that absolute values of the first pressure and the third pressure are increased while maintaining the second pressure and the fourth pressure.

* * * * *